US005437881A

United States Patent [19]

Jeannin

[11] Patent Number: 5,437,881

[45] Date of Patent: Aug. 1, 1995

[54] PACKAGE FOR FOOD PRODUCTS

[75] Inventor: Bernard Jeannin, Dijon, France

[73] Assignee: Nestec S.A., Vevey, Switzerland

[21] Appl. No.: 100,604

[22] Filed: Jul. 30, 1993

Related U.S. Application Data

[63] Continuation of Ser. No. 971,251, Nov. 3, 1992, abandoned, which is a continuation of Ser. No. 542,840, Jun. 22, 1990, abandoned.

[30] Foreign Application Priority Data

Jul. 1, 1989 [EP] European Pat. Off. ..... 89112028

[51] Int. Cl.[6] ..... B65D 85/00

[52] U.S. Cl. ..... 426/122; 383/200; 426/123

[58] Field of Search ..... 426/122, 123, 124, 115, 426/106, 392, 394, 410; 220/252, 257–259, 265, 266, 268–270; 383/200, 203, 207, 208; 229/87.05, 87.08, 927, 87.12, 87.13; 206/491, 525

[56] References Cited

U.S. PATENT DOCUMENTS

| | | | |
|---|---|---|---|
| 1,578,066 | 3/1926 | Bolingbroke . | |
| 1,869,313 | 7/1932 | Mackay . | |
| 2,248,266 | 7/1941 | Abrams . | |
| 2,499,313 | 2/1950 | Hoag | 426/122 |
| 2,791,324 | 5/1957 | Knoop et al. | 426/122 |
| 3,266,713 | 8/1966 | Martensson et al. . | |
| 3,295,739 | 1/1967 | Wilcox . | |
| 3,373,926 | 3/1968 | Voigtman, Sr. et al. . | |
| 3,451,539 | 6/1969 | Wysocki . | |
| 3,552,631 | 1/1971 | Fuchs . | |
| 3,955,001 | 5/1976 | Kuepach et al. | 426/122 |
| 4,139,643 | 2/1979 | Hix et al. . | |
| 4,290,526 | 9/1981 | Haiss . | |
| 4,312,450 | 1/1982 | Reil . | |
| 4,387,809 | 6/1983 | Botzler | 426/122 |
| 4,811,848 | 3/1989 | Jud . | |
| 4,830,273 | 5/1989 | Kalberer et al. . | |

FOREIGN PATENT DOCUMENTS

| | | | |
|---|---|---|---|
| 1264317 | 3/1968 | Germany . | |
| 4-72162 | 3/1992 | Japan | 426/122 |
| 98331 | 6/1961 | Netherlands . | |
| 4491 | of 1892 | United Kingdom | 426/122 |
| 2077688 | 12/1981 | United Kingdom | 426/122 |

OTHER PUBLICATIONS

Bakker et al. The Wiley Encyclopedia of Packaging Technology. 1986. published by John Wiley and Sons. New York. pp. 14–16, 126, asnd 127.

*Primary Examiner*—Anthony J. Weier
*Attorney, Agent, or Firm*—Vogt & O'Donnell

[57] ABSTRACT

A packaged food product includes a rigid food product bar which has a width, a height and a length extending between end edges of the bar and a package provided by a hand-tearable product packaging material enclosing the bar having a notch positioned therein. The notch is a single linear slit positioned adjacent and parallel to an end edge of the enclosed bar and the notch has a length less than the width of the enclosed bar. The notch is covered on an interior surface of the packaging material by a cover material which liquefies when heated to a temperature compatible with the packaging material, which is adhesive enough to remain on the notch, but which is weak enough to break when the package is bent by leveraging the product contained in the package against the packaging material interior adjacent the covered notch.

8 Claims, 1 Drawing Sheet

PACKAGE FOR FOOD PRODUCTS

CROSS REFERENCE TO RELATED APPLICATIONS

This is a continuation application of application Ser. No. 07/971,251, filed Nov. 3, 1992, now abandoned, which, in turn, is a continuing application of application Ser. No. 07/542,840, filed Jun. 22, 1990, now abandoned.

The present invention relates to an easy-opening package for a rigid or semi-rigid food product.

Easy-opening packages for bars of sweet and confectionery products such as chocolate are well known. Examples are systems comprising a zig-zag cut at each end of the package surrounding the bar, single notches or tear tabs on the sealed ends of the package and a tear tape that can be positioned lengthwise or widthwise on the package.

SUMMARY OF THE INVENTION

We have found that by realizing a notch in the packaging film substantially parallel and relatively near to one edge of the bar, the packaging film can be torn off at that end of the bar by holding the major part of the bar beyond the notch in one hand and bending or folding the packaging film with the other hand.

Accordingly the present invention provides a package for a bar of a rigid or semi-rigid food product comprising a packaging material enclosing a food product, the packaging material having a notch substantially parallel to an edge of the enclosed bar.

DETAILED DESCRIPTION OF THE INVENTION

The packaging material may be made of any conventional wrapping material which can be torn easily by hand as described below e.g., polypropylene, expanded polypropylene, paper, or complexed film. The packaging material may be cold sealed.

The notch is conveniently a simple slit in the packaging material and may have a curved, triangular or zigzag shape but is preferably a single linear slit. It is also possible that the notch could be a small hole in the packaging material with slits on opposite sides of the hole.

The length of the notch may vary depending upon the size or shape of the food product. Although the notch could extend over three sides of the package, i.e., to cover the width and twice the height of the enclosed bar, preferably the length of the notch is less than the width of one side of the bar parallel to the notch. For example, the length of the notch may be as little as 2 or 3 millimetres on a mini bar or may be up to 5 cms or more on a more conventionally sized bar. In terms of costs it is advantageous to make the notch as small as possible, and on a conventionally sized bar a notch length of 2 to 3 cms is sufficient.

Normally, the notch is eccentrically positioned towards an edge of the package. The position of the notch on the package is preferably very close to the edge of the package parallel to it so that only a very small length of the enclosed bar is present on one side of the notch. However, if the package contains two food products, e.g., two mini-bars, then the notch could be in the middle between the products.

Advantageously, the notch is covered by an adhesive member which may or may not be releasably attached to the packaging material for hygienic reasons or to prevent accidental tearing.

The adhesive member may be a sticker with a prehensile end which may be removed partially or totally by grasping the prehensile end and pulling off. Alternatively, the adhesive member may be a sticker with adapted glue having a high-traction strength and a weak sheer force placed on the inner surface of the sticker, e.g., POST-IT from 3M. In this latter case, it is not necessary to remove the sticker before opening, and the opening operation can be carried out in one step. The adhesive member could also be a sticker made of tearable aluminium placed on the outer surface of the packaging material.

Alternatively, the notch may be covered on its inner or outer surface by a coating or sprayed substance such as resin, hot melt or gel which liquefies when heated to a temperature compatible with the wrapping material and which is adhesive enough to remain on the slit, but weak enough to break when the wrapping material is opened by treating. This possibility can be adapted onto the wrapping machine and could be carried out by the supplier just after forming the notch.

The food product may be, for example, a chocolate bar or an iced bar. It may be of various shapes, for examples, square, oval, circular or rectangular.

When the bar of food product is rectangular in shape the notch advantageously extends transversely in the packaging material on the upper longitudinal side of the package a few millimetres from a short edge.

This system can be fully integrated into the production line by integrating a cutting instrument and a ticket dispenser on the machine, e.g., a tubular horizontal wrapper or a vertical wrapping machine. Alternatively, the cutting of the notch may be carried out by the supplier of the packaging material.

The present invention is illustrated by way of example only with reference to the accompanying drawings in which

DETAILED DESCRIPTION OF THE DRAWINGS

Figures 1, 2, 3, 4, 5, 6, 7, 8, 9:
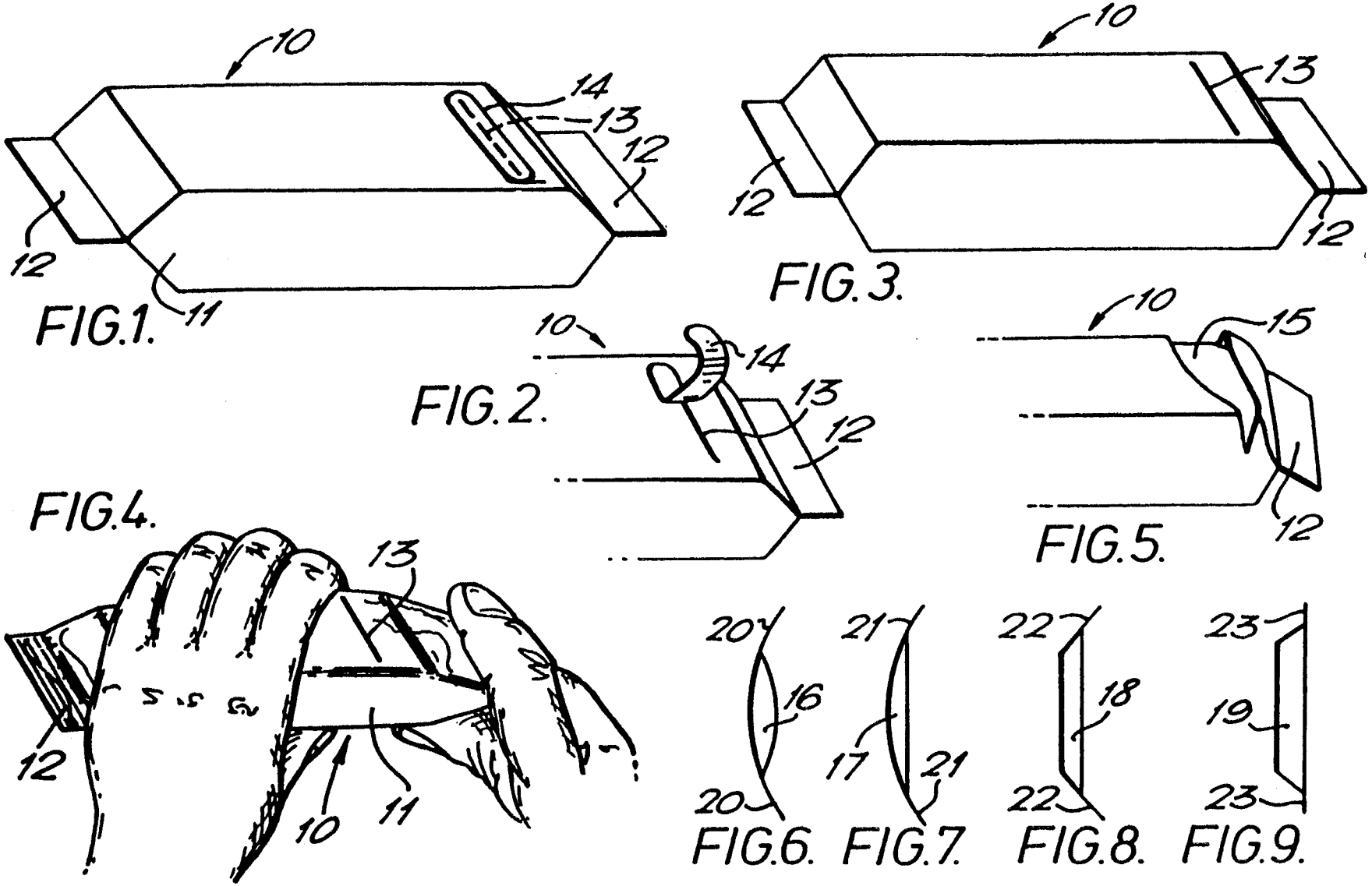
FIG. 1 illustrates a chocolate bar enclosed by a packaging film according to the invention.
FIGS. 2 to 5 illustrate the various stages of opening the package of FIG. 1.
FIGS. 6 to 9 illustrate the shapes of various notches comprising holes.

Referring to FIG. 1, a bar of chocolate is contained in a package generally designated 10 is made of polypropylene cold sealed at each end 12 and having positioned 0.5 cm from the edge of the bar, a notch 13 of length 2 cm covered with a sticker 14.

FIG. 2 shows the sticker 14 being removed from the bar to expose the notch 13 shown in FIG. 3 with the sticker completely removed. The package is opened to expose the chocolate by grasping the packaged bar with the left hand as shown in FIG. 4 and bending or folding the packaging material 11 on the right hand side of the notch 13 with the right hand using the rigidity of the bar as a lever whereupon the packaging material tears off neatly to make the right hand end of the bar 15 visible as shown in FIG. 5. If desired, it is possible to open the package completely by continuing to pull the packaging material with the right hand whereby the longitudinal sealing at the sole of the package acts like a tear tape.

Referring to FIGS. 6 to 9, the notches comprise elongate holes 16,17,18,19 at each end of which are slits 20,21,22 and 23.

As illustrated in FIG. 6, hole 16 has a shape of a double convex lens, i.e., two intersecting arcs. Slits 20 extend from each of the opposing ends of the lens at the intersection of the arc of the lens.

As illustrated in FIG. 7, hole 17 has a shape of a single convex lens, i.e., an arc of a circle meeting a straight edge. Slit 21 extends from each of the opposing ends of the arc of the lens.

As illustrated in FIGS. 8 and 9, holes 18 and 19, respectively, have a trapezoidal shape. Slits 22 of FIGS. 8 extend from ends of the non-parallel sides of the trapezoid and, as illustrated, from the ends of the trapezoid connected to the base to beyond the base of the trapezoid. Slits 23 of FIG. 9 extend from each end of one of the parallel sides of the trapezoid and, as illustrated, from the sides connected to the trapezoid base.

I claim:

1. A packaged food product comprising a rigid food product bar which has a width, a height and a length extending between end edges of the bar; a package comprising a hand-tearable product packaging material enclosing the bar having a notch positioned therein, wherein the notch is a single linear slit positioned adjacent and parallel to an end edge of the enclosed bar and wherein the notch has a length less than the width of the enclosed bar; and a material covering the notch on an interior surface of the packaging material which liquefies when heated to a temperature compatible with the packaging material and which is adhesive enough to remain on the notch but which is weak enough to break when the package is bent by leveraging the product contained in the package against the packaging material interior adjacent the covered notch.

2. A packaged food product according to claim 1 wherein the package further comprises a graspable end tab which, upon leveraged rotation out of a longitudinal plane defined by the length of the enclosed bar, impacts the bar against the packaging material adjacent the covered notch to open the package for removing the product.

3. A package according to claim 1 or 2 wherein the notch-covering material is a resin.

4. A package according to claim 1 or 2 wherein the notch-covering material is a hot melt.

5. A package according to claim 1 or 2 wherein the notch-covering material is a gel.

6. A package according to claim 1 or 2 wherein the packaging material is polypropylene.

7. A package according to claim 1 or 2 wherein the packaging material is paper.

8. A package according to claim 1 or 2 wherein the packaging material is complexed film.

* * * * *